US006854871B1

(12) United States Patent
Morton

(10) Patent No.: US 6,854,871 B1
(45) Date of Patent: Feb. 15, 2005

(54) LIGHTED ORNAMENTAL DEVICE, KIT AND METHOD OF USING

(76) Inventor: Serita S. Morton, 3018 Howard Anderson Rd., Halifax, VA (US) 24558

( * ) Notice: Subject to any disclaimer, the term of this patent is extended or adjusted under 35 U.S.C. 154(b) by 11 days.

(21) Appl. No.: 10/369,467

(22) Filed: Feb. 20, 2003

(51) Int. Cl.[7] ..... A47G 35/00

(52) U.S. Cl. ..... 362/565; 362/252; 362/809; 362/249; 362/240; 362/238; 362/360; 362/361; 362/363; 362/396; 362/404; 362/806

(58) Field of Search ..... 362/565, 252, 362/809, 249, 240, 238, 360, 361, 363, 396, 404, 806; D11/121

(56) References Cited

U.S. PATENT DOCUMENTS

D425,442 S * 5/2000 Sims ..... D11/121
6,663,260 B1 * 12/2003 Tieszen ..... 362/249

* cited by examiner

*Primary Examiner*—Stephen Husar
*Assistant Examiner*—Bertrand Zeade

(57) ABSTRACT

A lighted ornamental device, kit and associated method of using the kit to illuminate the lighted ornamental device is disclosed. The device comprises a miniature light set attached to a plurality of interconnected adjoined cups. The miniature light set includes: an electrical plug; at least two electrical wires operatively connected to the electrical plug; and a plurality of lighting elements operatively connected to the electrical wires, in which each lighting element has: a base attached to the electrical wires; and a light emitter operatively connected to the two electrical wires. The plurality of interconnected adjoined cups is attached to the miniature light set forming a geometrical figure, such as a sphere. Each cup includes: a generally circular bottom; a side wall; at least one weld joint in the side wall of each cup attaching adjoining cups together; and a hole in the bottom of each cup in which at least lighting element of the plurality of lighting elements of the miniature light set is attached to the bottom of each cup of the plurality of interconnected cups. The, kit comprises the unconnected components of the device. The method comprises the steps of aligning, attaching, blowing, boring, conjoining, connecting hanging, heating, inserting, locking, obtaining, piercing, repeating, and selecting.

1 Claim, 4 Drawing Sheets

LIGHTED ORNAMENTAL DEVICE, KIT AND METHOD OF USING

FIELD OF THE INVENTION

The present invention relates to decorative lighting systems, more particularly, to a lighted ornamental device, kit and associated method of using.

DESCRIPTION OF THE PRIOR ART

Ornaments have long been used to recognize holidays such as Christmas and Halloween. The ornaments are typically hung indoors or outdoors, e.g., from trees, buildings, store front signs, and other structures which may be adapted to hang bulbs or other festive ornamentation from. Generally, there has been the use of both bulbs and strings of lights. Often times, the strings of lights might be secured to the exterior of a cutout shape, to form an image of characters such as Santa Claus, a reindeer, snowmen, etc.

It is traditional to decorate trees, both indoor and outdoor trees, with strings of lights as well as different types of ornaments. Such decorations result in beautiful lighted trees with ornaments hanging therefrom. Traditionally, ornaments have been used less frequently on outdoor trees and structures, however, since the ornaments are often difficult to see at night unless there is another source of light.

A wide variety of lighted holiday ornaments is, currently available on the commercial market and an even larger number of these types of devices are known in the art of lighted holiday ornaments, for example, the miniature electric light bulb sets for decorative illumination disclosed by Matsuya in U.S. Pat. No. 4,228,486; the lighted holiday ornament disclosed by Pihl-Niedennan et al. in U.S. Pat. No. 5,772,312; the decorative lighting system in cluster arrangement disclosed by Barthelemess in U.S. Pat. No. 5,868,490; the lamp disclosed by Jones in U.S. Pat. No. D262,743; the star ornament light disclosed by Edwards in U.S. Pat. No. D386,279; and the lighted ornament disclosed by Sims in U.S. Pat. No. D425,442.

While all of the above-described devices fulfill their respective, particular objectives and requirements, the aforementioned patents do not describe a lighted ornamental device having a miniature light set attached to a plurality of interconnected adjoined cups forming a geometrical figure, such as a sphere, in which each cup has at least one weld joint in the side wall attaching adjoining cups together, and having a hole in the bottom of each cup in which at least lighting element of the plurality of lighting elements of the miniature light set is attached to the bottom of each cup of the plurality of interconnected cups. This combination of elements would specifically match the user's particular individual needs of making it possible to provide the device as a decorative ornament during a special occasion, such as, a Christmas ornamental display, a Chanukah display, a birthday ornamental display, etc. The above-described patents make no provision for a lighted ornamental device having a miniature light set attached to a plurality of interconnected adjoined cups forming a geometrical figure, such as a sphere, in which each cup has at least one weld joint in the side wall attaching adjoining cups together; and having a hole in the bottom of each cup in which at least lighting element of the plurality of lighting elements of the miniature light set is attached to the bottom of each cup of the plurality of interconnected cups.

Therefore, a need exists for a new and improved lighted ornamental device having a miniature light set attached to a plurality of interconnected adjoined cups forming a geometrical figure, such as a sphere, in which each cup has at least one weld joint in the side wall attaching adjoining-cups together; and having a hole in the bottom of each cup in which at least lighting element of the plurality of lighting elements of the miniature light set is attached to the bottom of each cup of the plurality of interconnected cups. In this respect, the lighted ornamental device according to the present invention substantially departs from the conventional concepts and designs of the prior art, and in doing so provides an apparatus primarily developed for the purpose of providing a means for displaying the device as a decorative ornament during a special occasion, such as, a Christmas ornamental display, a Chanukah display, a birthday ornamental display, etc.

SUMMARY OF THE INVENTION

The present device, kit and method of using, according to the principles of the present invention, overcomes the shortcomings of the prior art by providing a lighted ornamental device, kit and method of using are disclosed. The device comprises a miniature light set attached to a plurality of interconnected adjoined cups. The miniature light set includes: an electrical plug; at least two electrical wires operatively connected to the electrical plug; and a plurality of lighting elements operatively connected to the electrical wires, in which each lighting element has: a base attached to the electrical wires; and a light emitter operatively connected to the two electrical wires. The plurality of interconnected adjoined cups are attached to the miniature light set forming a geometrical figure, such as a sphere. Each cup includes: a generally circular bottom; a side wall; at least one weld joint in the side wall of each cup attaching adjoining cups together, and a hole in the bottom of each cup in which at least lighting element of the plurality of lighting elements of the miniature light set is attached to the bottom of each cup of the plurality of interconnected cups. The kit comprises the unconnected components of the device. The method comprises the steps of aligning, attaching, blowing, boring, conjoining, connecting, hanging, heating, inserting, locking, obtaining, piercing, repeating, and selecting in view of the foregoing disadvantages inherent in the known type ornamental lighted devices now present in the prior art, the present invention provides an improved lighted ornamental device, which will be described subsequently in great detail, is to provide a new and improved lighted ornamental device which is not anticipated, rendered obvious, suggested, or even implied by the prior art, either alone or in any combination thereof.

To attain this, the present invention essentially comprises a miniature light set attached to a plurality of interconnected adjoined cups. The miniature light set includes: an electrical plug; at least two electrical wires operatively connected to the electrical plug; and a plurality of lighting elements operatively connected to the electrical wires, in which each lighting element has: a base attached to the electrical wires; and a light emitter operatively connected to the two electrical wires. The plurality of interconnected adjoined cups are attached to the miniature light set forming a geometrical figure, such as a sphere. Each cup includes: a generally circular bottom; a side wall; at least one weld joint in the side wall of each cup attaching adjoining cups together; and a hole in the bottom of each cup in which at least lighting element of the plurality of lighting elements of the miniature light set is attached to the bottom of each cup of the plurality of interconnected cups.

There has thus been outlined, rather broadly, the more important features of the invention in order that the detailed description thereof that follows may be better understood, and in order that the present contribution of the art may be better appreciated.

The invention may also include hook attached to the plurality of cups. There are of course, additional features of the invention that will be described hereinafter and which will form the subject matter of the claims attached.

Numerous objects, features and advantages of the present invention will be readily apparent to those of ordinary skill in the art upon reading of the following detailed description of presently preferred, but nonetheless illustrative, embodiments of the present invention when taken in conjunction with the accompany drawings. In this respect, before explaining the current embodiment of the invention in detail, it is to be understood that the invention is riot limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved lighted ornamental device that has all the advantages of the prior art lighted ornamental device and none of the disadvantages.

It is another object of the present invention to provide a new and improved lighted ornamental device that may be easily and efficiently manufactured and marketed.

An even further object of the present invention is to provide a new and improved lighted ornamental device that has a low cost of manufacture with regard to both materials and labor, and which accordingly is then susceptible of low prices of sale to the consuming public, thereby making such multipurpose storage unit and system economically available to the buying public.

Still another object of the present invention is to provide a new lighted ornamental device that provides in the apparatuses and methods of the prior art some of the advantages thererof, while simultaneously overcoming some of the disadvantages normally associated therewith.

Even still another object of the present invention is to provide a lighted ornamental device having a miniature light set attached to a plurality of interconnected adjoined cups forming a geometrical figure, such as a sphere, in which each cup has at least one weld joint in the side wall attaching adjoining cups together; and having a hole in the bottom of each cup in which at least lighting element of the plurality of lighting elements of the miniature light set is attached to the bottom of each cup of the plurality of interconnected cups. This combination of elements makes it possible to provide the device as a decorative ornament during a special occasion, such as, a Christmas ornamental display, a Chanukah ornamental display, a birthday ornamental display, etc.

Still another object of the present invention is to provide a kit comprising unassembled components of the device.

Lastly, it is an object of the present invention to provide a new and improved method of using comprising the steps of aligning, attaching, blowing, boring, conjoining, connecting, hanging, heating, inserting, locking, obtaining, piercing, repeating, and selecting.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in anyway.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and description matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE PREFERRED EMBODIMENT

Figure 1:
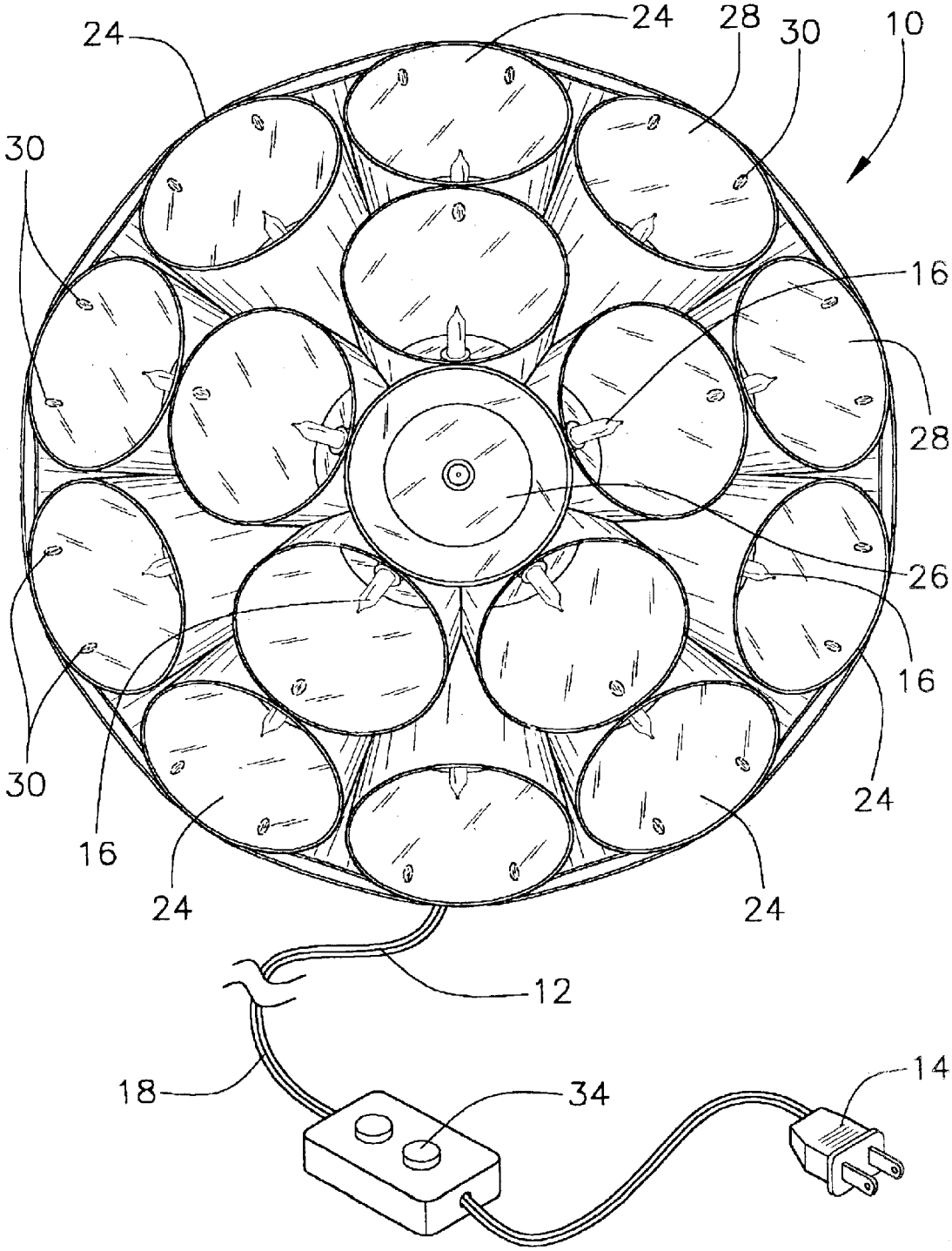
FIG. 1 is a perspective view of a preferred embodiment of the lighted ornamental device constructed in accordance with the principles of the present invention.

Referring now to the drawings, and in particular FIGS. 1 to 5 thereof, one preferred embodiment of the present invention is shown and generally designated by the reference numeral 10. One preferred embodiment of a lighted ornamental device 10 comprising: a miniature light set 12 attached to a plurality of interconnected adjoined cups 24. The miniature light set 12 includes: an electrical plug 14; at least two electrical wires 18 operatively connected to the electrical plug 14; and a plurality of lighting elements 16 operatively connected to the electrical wires 18, each lighting element 16 having: a base 20 attached to the electrical wires 18; and a light emitter 22 operatively connected to the two electrical wires 18, each light emitter 22 is detachably attached to each corresponding base 20. The plurality of interconnected adjoined cups 24 attached to the miniature light set 12 for a geometrical figure. Each cup 24 includes: a generally circular bottom 26 having a circumference; a side wall 28 attached around the circumference of the bottom 26, the side wall 28 and the circular bottom 26 forming a hollow drinking chamber in each cup 24; at least one weld joint 30 in the side wall 28 of each cup 24, the weld joint 30 attaching adjoining cups 24 together, and an annular collar attached to the bottom 26 of each cup 24, the collar defining a hole in the bottom 26 of each cup 24, at least lighting element 16 of the plurality of lighting elements 16 of the miniature light set 12 is attached to the bottom 26 of each cup 24 of the plurality of interconnected cups 24.

An optional hook 32 may be added to the device 10 in which the hook 32 is attached to the plurality of interconnected adjoining cups 24.

Another preferred embodiment of a lighted ornamental device 10 consist essentially of: a miniature light set 12 attached to a plurality of interconnected adjoined cups 24. The miniature light set 12 includes: an electrical plug 14; at least two electrical wires 18 operatively connected to the electrical plug 14; and a plurality of lighting elements 16 operatively connected to the electrical wires 18, each lighting element 16 having: a base 20 attached to the electrical wires 18; and a light emitter 22 operatively connected to the two electrical wires 18, each light emitter 22 is detachably attached to each corresponding base 20. The plurality of interconnected adjoined cups 24 attached to the miniature light set 12 for a geometrical figure. Each cup 24 includes: a generally circular bottom 26 having a circumference; a side wall 28 attached around the circumference of the bottom 26, the side wall 28 and the circular bottom 26 forming a hollow drinking chamber in each cup 24; at least one weld joint 30 in the side wall 28 of each cup 24, the weld joint 30 attaching adjoining cups 24 together; and an annular collar attached to the bottom 26 of each cup 24, the collar defining a hole in the bottom 26 of each cup 24, at least lighting element 16 of the plurality of lighting elements 16 of the miniature light set 12 is attached to the bottom 26 of each cup 24 of the plurality of interconnected cups 24.

The miniature light set 12 may be any commercially available miniature light set 12. One preferred configuration of the miniature light set 12 has a control box 34 attached to the wires 18, in which the control box 34 is operatively connected to the plurality of lighting elements 16.

The light emitters 22 of the plurality of lighting elements 16 may comprise any commercially known light emitters. One preferred configuration of the light emitters 22 of the plurality of lighting elements 16 comprises an incandescent light bulb. Another preferred configuration of the light emitters 22 of the plurality of lighting elements 16, comprises an light emitting diode. Yet another preferred configuration of the light emitters 22 of the plurality of lighting elements 16 comprises a laser. Still another preferred configuration of the light emitters 22 of the plurality of lighting elements 16 comprises an fabric optic light emitter 22.

The cups 24 of the plurality of interconnected adjoined cups 24 may be any commercially available cups 24. One preferred configuration is that each cup 24 of the plurality of interconnected adjoined cups 24 is made of plastic. Another preferred configuration is that each cup 24 of the plurality of interconnected adjoined cups 24 is made of semi-transparent plastic.

The geometric figure may be any known geometric figure. The geometric figure may be selected from the group consisting of a triangle, a square, a box 34, a cone, a pentagon, a pentacle, a hexagon, and a hexagram. A most preferred configuration of the geometric figure is that it is shaped as a sphere.

One preferred embodiment of a kit for assembling a lighted ornamental device 10, the kit comprises: a miniature light set 12 including: an electrical plug 14; at least two electrical wires 18 operatively connected to the electrical plug; and a plurality of lighting elements 16 operatively connected to the electrical wires 18, each lighting element 16 having: a base 20 attached to the electrical wires 18; and a light emitter 22 operatively connected to the two electrical wires 18, each light emitter 22 detachably attached to each corresponding base 20; and a plurality of cups 24, each cup 24 of the plurality of cups 24 comprising: a generally circular bottom 26 having a circumference; and a side wall 28 attached around the circumference of the bottom 26, the side wall 28 and the circular bottom 26 forming a hollow drinking chamber in each cup 24.

An optional hook 32 may be added to the kit. One preferred configuration of the optional hook 32 is that it is a ceiling hook 32.

An optional probe 36 may be added to the kit The probe may be selected from the group consisting of a nail, a lance, a pointed elongated metal shaft, and an awl.

An optional drill bit 38 may be added to the kit. The drill bit 38 may be any commercially available drill bit 38. One preferred configuration of the drill bit 38 is that it has a diameter greater than the width of each light emitter 22 of the plurality of lighting elements 16, and that the diameter of the drill bit 38 is less than the width of each base 20 of the plurality of lighting elements 16.

An optional electrical drill 40 may also be added to the kit.

Another preferred embodiment of a kit for assembling a lighted ornamental device 10, the kit consist essentially of: a miniature light set 12 including: an electrical plug 14; at least two go electrical wires 18 operatively connected to the electrical plug; and a plurality of lighting elements 16 operatively connected to the electrical wires 18, each lighting element 16 having: a base 20 attached to the electrical wires 18; and a light emitter 22 operatively connected to the two electrical wires 18, each light emitter 22 detachably attached to each corresponding base 20; and a plurality of cups 24, each cup 24 of the plurality of cups 24 comprising: a generally 25 circular bottom 26 having a circumference; and a side wall 28 attached around the circumference of the bottom 26, the side wall 28 and the circular bottom 26 forming a hollow drinking chamber in each cup 24.

The miniature light set 12 of the kit may be any commercially available miniature light set 12. One preferred configuration of the miniature light set 12 has a control box 34 attached to the wires 18, in which the control box 34 is operatively connected to the plurality of lighting elements 16.

A preferred embodiment of a method of using a kit for assembling and displaying a lighted ornamental device 10, the method comprising the steps of: aligning, attaching, blowing, boring, conjoining, connecting, hanging, heating, inserting, locking, obtaining, piercing, repeating, and selecting. The obtaining step comprises obtaining the kit comprising: a miniature light set 12 including: an electrical plug 14; at least two electrical wires 18 operatively connected to the electrical plug; and a plurality of lighting elements 16 operatively connected to the electrical wires 18, each lighting element 16 having: a base 20 attached to the electrical wires 18; and a light emitter 22 operatively connected to the two electrical wires 18, each light emitter 22 detachably attached to each corresponding base 20, wherein the miniature light set 12 having a control box 34 attached to the wires 18, the control box 34 is operatively connected to the plurality of lighting elements 16; a plurality of cups 24, each cup 24 of the plurality of cups 24 including: a generally circular bottom 26 having a circumference; and a side wall 28 attached around the circumference of the bottom 26, the side wall 28 and the circular bottom 26 forming a hollow drinking chamber in each cup 24 a hook 32; a probe 36, wherein the probe 36 is selected from the group consisting of a nail, a lance, a pointed elongated metal shaft, and an awl; a drill bit 38, the drill bit 38 having a diameter greater than the width of each light emitter 22 of the plurality of lighting elements 16, wherein the diameter of the drill bit 38 is less than the width of each base 20 of the plurality of lighting elements 16; and an electrical drill 40. The locking step comprises locking the drill bit 38 to the electrical drill 40. The boring step comprises boring a hole through the bottom 26 of each cup 24 of the plurality of cups 24 with the drill bit 38 locked to the electrical drill 40, wherein the boring of the hole in the bottom 26 of each cup 24 of the plurality of cups 24 forming an annular collar attached to the bottom 26 of each cup 24 of the plurality of cups 24. The inserting step comprises inserting slidably at least one lighting element 16 of the plurality of lighting elements 16 of the miniature light set 12 through the hole in the bottom 26 of each cup 24 of the plurality of cups 24 so that the at least one light emitter 22 is inserted from the bottom 26 of each cup 24 into the drinking chamber of each cup 24 of the plurality of cups 24. The conjoining step comprises conjoining together the base 20 of at least one lighting element 16 of the plurality of lighting elements 16 of the miniature light set 12 to the bottom 26 of each cup 24 of the plurality of cups 24 so that the base 20 of at least one lighting element 16 of the plurality of lighting elements 16 of the miniature light set 12 is frictionally conjoined to the annular collar attached to the bottom 26 of each cup 24 of the plurality of cups 24. The selecting step comprises selecting two cups 24 of the plurality of cups 24. The aligning step comprises aligning adjacently together the selected two cups 24 of the plurality of cups 24 next to each other so that both of the side walls 28 of the selected two cups 24 of the plurality of cups 24 contact each other. The heating step comprises heating the probe 36 with a flame. The piercing step comprises piercing both of the side walls 28 of the aligned cups 24 of the plurality of cups 24 with the heated probe 36 so that the heated probe 36 melts through a portion of the side walls 28 of the aligned cups 24 of the plurality of cups 24. The blowing step comprises blowing on the melted portion of the side walls 28 of the aligned cups 24 of the plurality of cups 24 to allow the melted portion of the side walls 28 of the aligned cups 24 of the plurality of cups 24 to congeal into a solidified weld joint 30 connecting the aligned cups 24 of the plurality of cups 24. The repeating step comprises repeating the steps of selecting, aligning, heating, piercing and blowing until a geometric figure of a sphere is created. The attaching step comprises attaching the hook 32 to the sphere. The hanging step comprises hanging the sphere from a ceiling. The connecting step comprises connecting operatively the electrical plug 14 of the miniature light set 12 into an electrical wall socket Another preferred embodiment of the method consist of the steps of aligning, attaching, blowing, boring, conjoining, connecting, hanging, heating, inserting, locking, obtaining, piercing, repeating, and selecting.

Figure 5:
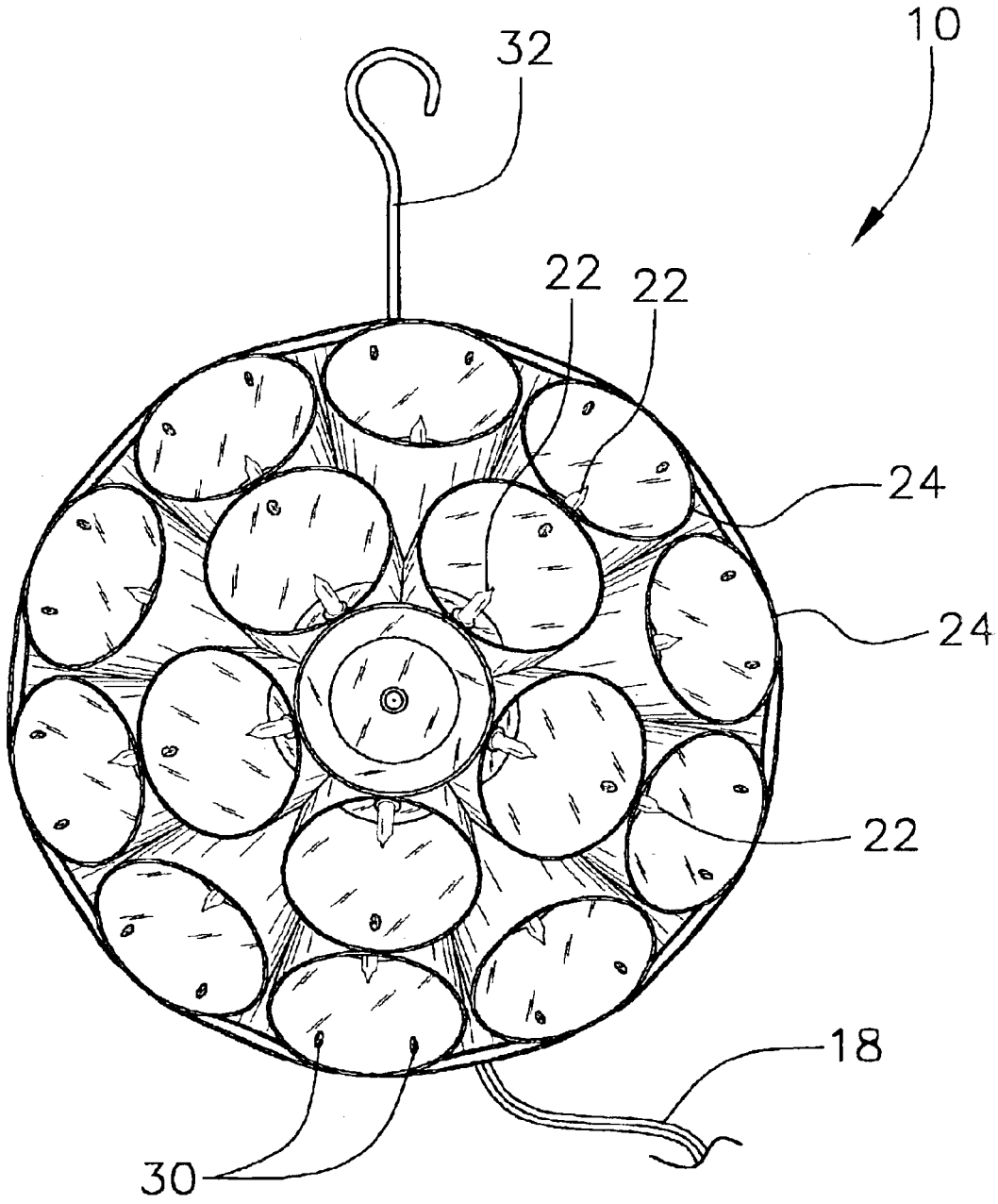
FIG. 5 is a perspective view of a preferred embodiment of the lighted ornamental device of the present invention.

Referring now to FIG. 1 and FIG. 5 which depict perspective view of preferred embodiments of the lighted ornamental device 10 showing a miniature light set 12 attached to a plurality of interconnected adjoined cups 24 and a hook 32. The miniature light set 12 is shown having an electrical plug 14; at least two electrical wires 18 operatively connected to the electrical plug 14; and a plurality of lighting elements 16 operatively connected to the electrical wires 18. The plurality of interconnected adjoined cups 24 are shown attached to the miniature light set 12 forming a geometrical figure of a sphere. Each cup 24 is shown having a generally circular bottom 26 with a side wall 28 attached around the circumference of the bottom 26; at least one weld joint 30 attaching adjoining cups 24 together, and an annular collar (not shown) attached to the bottom 26 of each cup 24, the collar defining a hole in the bottom 26 of each cup 24, at least lighting element 16 of the plurality of lighting elements 16 of the miniature light set 12 is attached to the bottom 26 of each cup 24 of the plurality of interconnected cups 24.

Figure 2:
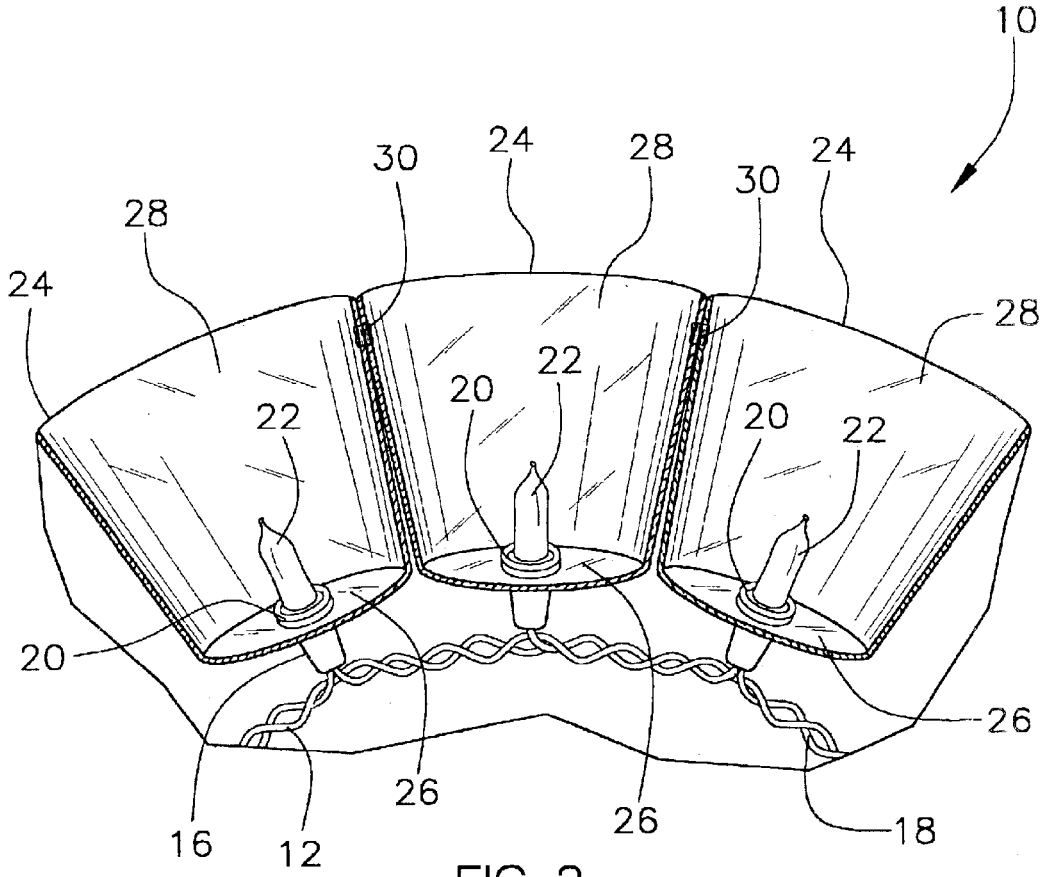
FIG. 2 is a cross sectional side view of a portion of a preferred embodiment of the lighted ornamental device of the present invention.

Referring now to FIG. 2 which depicts a cross sectional side view of a portion of a preferred embodiment of the lighted ornamental device 10 showing the miniature light set 12 attached to a plurality of interconnected adjoined cups 24. The miniature light set 12 is shown having at least two electrical wires 18; and a plurality of lighting elements 16 operatively connected to the electrical wires 18. Each lighting element 16 is shown having: a base 20 attached to the electrical wires 18; and a light emitter 22 operatively connected to the two electrical wires 18. The plurality of interconnected adjoined cups 24 is shown attached to the miniature light set 12. Each cup 24 includes: a generally circular bottom 26 having a circumference; a side wall 28 attached around the circumference of the bottom 26, the side wall 28 and the circular bottom 26 forming a hollow drinking chamber in each cup 24; at least one weld joint 30 in the side wall 28 of each cup 24, in which the weld joint 30 attaches adjoining cups 24 together; and an annular collar (not shown) attached to the bottom 26 of each cup 24, the collar defining a hole (not shown) in the bottom 26 of each cup 24, at least lighting element 16 of the plurality of lighting elements 16 of the miniature light set 12 is attached to the bottom 26 of each cup 24 of the plurality of interconnected cups 24.

Figure 3:
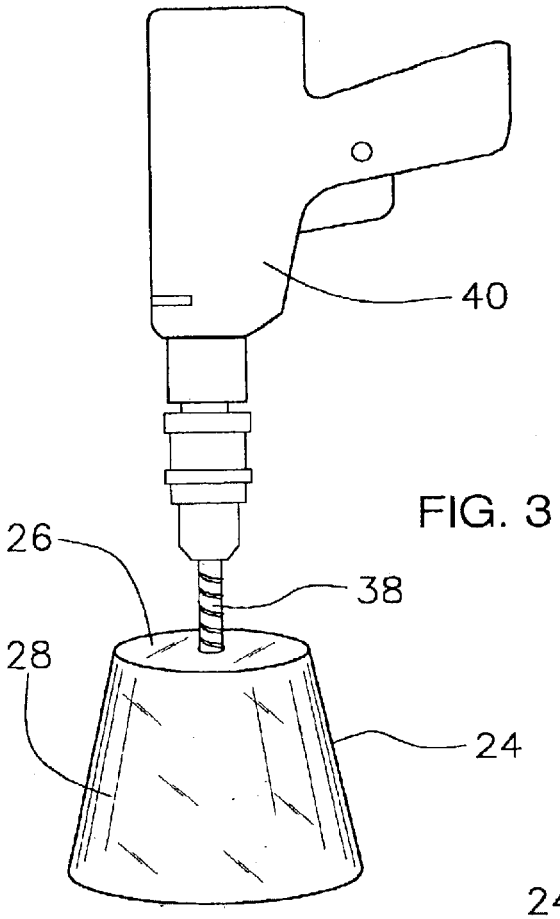
FIG. 3 is a perspective view of a portion of a preferred embodiment of the kit for the lighted ornamental device of the present invention.

Referring now to FIG. 3, which depicts a perspective view of a portion of a preferred embodiment of the kit showing an electric drill 40 with a drill bit 38 boring a hole in the bottom of a cup 24.

Figure 4:
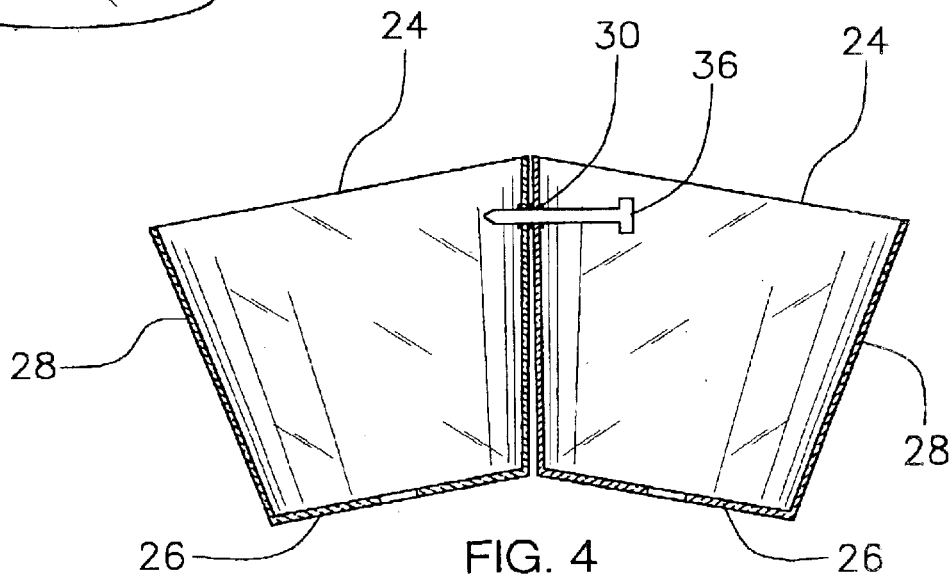
FIG. 4 is a cross sectional view of a portion of a preferred embodiment of the kit for the lighted ornamental device of the present invention.

Referring now to FIG. 4 which depicts a cross sectional view of a portion of a preferred embodiment of the kit showing two adjacent cups 24 being welded together with a heated probe 36.

As to the manner of usage and operation of the present invention, the same should be apparent from the above description. Accordingly, no further discussion relating to the manner of usage and operation will be provided.

While a preferred embodiment of the lighted ornamental device has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Throughout this specification, unless the context requires otherwise, the word "comprise" or variations such as "comprises" or "comprising" or the term "includes" or variations, thereof, or the term "having" or variations, thereof will be understood to imply the inclusion of a stated element or integer or group of elements or integers but not the exclusion of any other element or integer or group of elements or integers. In this regard, in construing the claim scope, an embodiment where one or more features is added to any of the claims is to be regarded as within this scope of the invention given that the essential features of the invention as claimed are included in such an embodiment.

Those skilled in the art will appreciate that the invention described herein is susceptible to variations and modifications other than those specifically described. It is to be understood that the invention includes all such variations and modifications which fall within its spirit and scope., The invention also includes all of the steps, features, compositions and compounds referred to or indicated in this specification, individually or collectively, and any and all combinations of any two or more of said steps or features.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of using a kit for assembling and displaying a lighted ornamental device, the method comprising the steps of:

obtaining the kit comprising:

a miniature light set including:

an electrical plug;

at least two electrical wires operatively connected to the electrical plug; and a plurality of lighting elements operatively connected to the electrical wires, each lighting element having:

a base attached to the electrical wires; and a light emitter operatively connected to the two electrical wires, each light emitter detachably attached to each corresponding base, wherein the miniature light set having a control box attached to the wires, the control box is operatively connected to the plurality of lighting elements;

a plurality of cups, each cup of the plurality of cups including:

a generally circular bottom having a circumference; and a side wall attached around the circumference of the bottom, the side wall and the circular bottom forming a hollow drinking chamber in each cup a hook;

a probe, wherein the probe is selected from the group consisting of a nail, a lance, a pointed elongated metal shaft, and an awl;

a drill bit, the drill bit having a diameter greater than the width of each light emitter of the plurality of lighting elements, wherein the diameter of the drill bit is less than the width of each base of the plurality of lighting elements; and an electrical drill;

locking the drill bit to the electrical drill;

boring a hole through the bottom of each cup of the plurality of cups with the drill bit locked to the electrical drill, wherein said boring of the hole in the bottom of each cup of the plurality of cups forming an annular collar attached to the bottom of each cup of the plurality of cups;

inserting slidably at least one lighting element of the plurality of lighting elements of the miniature light set through the hole in the bottom of each cup of the plurality of cups so that the at least one light emitter is inserted from the bottom of each cup into the drinking chamber of each cup of the plurality of cups;

conjoining together the base of at least one lighting element of the plurality of lighting elements of the miniature light set to the bottom of each cup of the plurality of cups so that the base of at least one lighting element of the plurality of lighting elements of the miniature light set is frictionally conjoined to the annular collar attached to the bottom of each cup of the plurality of cups;

selecting two cups of the plurality of cups;

aligning adjacently together the selected two cups of the plurality of cups next to each other so that both of the side walls of the selected two cups of the plurality of cups contact each other;

heating the probe with a flame;

piercing both of the side walls of the aligned cups of the plurality of cups with the heated probe so that the heated probe melts through a portion of the side walls of the aligned cups of the plurality of cups;

blowing on the melted portion of the side walls of the aligned cups of the plurality of cups to allow the melted portion of the side walls of the aligned cups of the plurality of cups to congeal into a solidified weld joint connecting the aligned cups of the plurality of cups;

repeating said steps of selecting, aligning, heating, piercing and blowing until a geometric figure of a sphere is created;

attaching the hook to the sphere;

hanging the sphere from a ceiling; and connecting operatively the electrical plug of the miniature light set into an electrical wall socket.

* * * * *